US005698127A

United States Patent [19]

Lai et al.

[11] Patent Number: 5,698,127

[45] Date of Patent: Dec. 16, 1997

[54] MICROWAVABLE CONTAINER WITH HEATING ELEMENT HAVING ENERGY COLLECTING LOOPS

[76] Inventors: Lawrence Lai, 887 The Greenway, Mississauga, Ontario, Canada, L5G 1P7; Neilson Zeng, 88 Mutual Street, Toronto, Ontario, Canada, M5B 2N3

[21] Appl. No.: 703,099

[22] Filed: Aug. 26, 1996

Related U.S. Application Data

[63] Continuation-in-part of Ser. No. 529,450, Sep. 18, 1995, abandoned.

[51] Int. Cl.[6] ..... H05B 6/80

[52] U.S. Cl. ..... 219/728; 219/729; 219/730; 219/759; 426/107; 426/234; 426/243; 99/DIG. 14

[58] Field of Search ..... 219/728, 729, 219/730, 725, 759, 734, 735; 426/107, 109, 234, 243, 241; 99/DIG. 14

[56] References Cited

U.S. PATENT DOCUMENTS

| | | | |
|---|---|---|---|
| 4,320,274 | 3/1982 | Dehn | 219/728 |
| 4,814,568 | 3/1989 | Keefer | 219/728 |
| 4,992,638 | 2/1991 | Hewitt et al. | 219/728 |
| 5,038,009 | 8/1991 | Babbitt | 219/730 |
| 5,117,078 | 5/1992 | Beckett | 219/728 |
| 5,310,980 | 5/1994 | Beckett | 219/728 |
| 5,322,984 | 6/1994 | Habeger, Jr. et al. | 219/728 |
| 5,354,973 | 10/1994 | Beckett | 219/730 |
| 5,391,864 | 2/1995 | Bodor et al. | 219/730 |
| 5,412,187 | 5/1995 | Walters et al. | 219/728 |
| 5,519,195 | 5/1996 | Keefer et al. | 219/728 |

*Primary Examiner*—Philip H. Leung

*Attorney, Agent, or Firm*—Gowling, Strathy & Henderson

[57] ABSTRACT

A microwavable container has an active microwave energy heating element to distribute energy. The active microwave energy heating element includes a plurality of loops interspersed with islands. Similar structures may be used in the tray to distribute energy through the tray. Alternatively, resonant loops interconnected by transmission lines may be dispersed over the tray to distribute energy.

36 Claims, 6 Drawing Sheets

MICROWAVABLE CONTAINER WITH HEATING ELEMENT HAVING ENERGY COLLECTING LOOPS

RELATED APPLICATIONS

The present application is a continuation-in-part of U.S. application Ser. No. 08/529,450 filed on Sep. 18, 1995 for an invention entitled "Microwavable Container" now abandoned.

FIELD OF THE INVENTION

The present invention relates to packages for food products and in particular to a microwavable container and an active microwave energy heating element for the same.

BACKGROUND OF THE INVENTION

Microwave ovens have become a principle form of cooking food in a rapid and effective manner and the number of food products available for preparation in a microwave oven is constantly increasing. As the market for microwavable food products has increased, so the sophistication required from such food products has also increased. There is, therefore, a continuing demand to improve the quality of food prepared in a microwave oven and to ensure that when it is presented to the consumer, the food product is attractive and meets the standards normally associated with such food.

Foods that are specially prepared for cooking within a microwave oven are delivered to the consumer in containers that may be used directly within the microwave oven to facilitate preparation. These containers must therefore not only be capable of containing the food product during transport in an effective manner but must also be capable of contributing to the cooking of the food product within the microwave oven and the subsequent presentation of the food product.

As the demand for more sophisticated food products increases, so the demand for effects, particularly appearance, normally associated with food preparation also increases. For example, it is desirable for a food product that includes a pastry shell or lid to have a browned appearance, so that it appears to have been baked. While these effects can be produced in isolation, it becomes more difficult to produce such an effect in combination with a container that can also uniformly heat the food product within a time that offers advantages over conventional cooking techniques.

Typically, the areas in which browning or crisping are required are those on the outer surfaces of the food product. Those areas typically receive the highest proportion of incident microwave radiation and therefore cook or heat the quickest. On the other hand, there are areas of the food product that are relatively shielded from incident microwave radiation or exist in a region of a minimum RF field and which therefore require longer cooking periods. If, however, a longer cooking period is provided, the outer surfaces of the food product tend to char and bum, leading to an unacceptable food product.

Various attempts have been made in the past to provide containers that will produce effects normally associated with cooked foods. For example, U.S. Pat. No. 5,322,984 to Habeger, Jr. et al. and assigned to The James River Corporation suggests a container having heating devices on the bottom wall and possibly the top wall of the container. The heating devices include antennae bridged by transmission lines. The antennae and transmission lines are made of highly conductive material to avoid significant resistive losses which will result in the improper functioning of the container. The heating devices are designed to provide a charring effect normally associated with barbecuing by directing energy normally not incident upon the food product into specific regions. This is purported to produce a localised charring of the food product. Overall, however, such containers have not been successful. The charring effect produced on the food product may be attributed to the high field intensifies and associated induced currents that result from the concentration of energy at particular locations. In practice it is found that those induced currents may also cause charring and burning of the container itself.

It has also been found that in order to produce the required results for the preparation of the food product, the container must be capable of controlling distribution of energy about the food product, to utilize the energy in the most efficient manner, and at the same time ensure that the food product and the container provide a pleasant and acceptable finished product. Also, the containers must be able to hold the food product securely to avoid damage to the food product during transport. It has been found that in the case of pizza containers, conventional designs have not been adequate resulting in separation between the pizza crust and the toppings during transport.

It is therefore an object of the present invention to provide a novel food product package and an active microwave energy heating element for the same which obviates or mitigates at least one of the above disadvantages.

SUMMARY OF THE INVENTION

According to one aspect of the present invention there is provided an active microwave energy heating element for incorporation into a microwavable container having a substrate, a plurality of energy collecting loops distributed on one surface of said substrate to receive incident microwave energy and each having a pair of concentric closed conductors separated by an annular land, a plurality of islands of microwave energy interactive material located between selected ones of said loops and spaced therefrom to obtain the requisite coupling between said loops and said islands, said islands having a perimeter sufficient to limit currents induced therein to below a predetermined level at which charring of said substrate may occur.

According to another aspect of the present invention there is provided a microwavable container having an outer sleeve, a tray within said sleeve and an active microwave energy heating element within said sleeve and disposed opposite to said tray, said active microwave energy heating element having a substrate, a plurality of energy collecting loops distributed on one surface of said substrate to receive incident microwave energy and each having a pair of concentric closed conductors separated by an annular land, a plurality of islands of microwave energy interactive material located between selected ones of said loops and spaced therefrom to inhibit coupling between said loops and said islands, said islands having an area sufficient to limit fringe currents therein to below a predetermined level at which charring of said substrate may occur.

According to yet another aspect of the present invention there is provided a tray for a microwavable container, said tray having a substrate, a food contacting surface to support and contain a food product and a plurality of energy distributing structures formed adjacent said food contacting surface to distribute energy within said tray, said energy distributing structures including a plurality of energy collecting loops of distributed structures about said food contacting surface, pairs of said loops being interconnected by transmission fines to provide a progressive power loss between said pairs of loops.

According to still yet another aspect of the present invention there is provided a tray for a microwavable container comprising a substrate and a plurality of energy collecting structures disposed across a surface of said substrate, said structures including resonant loops having a perimeter sufficient to limit currents induced therein to below a predetermined level whereby upon impingement by incident microwave energy, said structures distribute energy across said surface and thereby inhibit charring of said substrate, pairs of resonant loops being interconnected by transmission lines, said transmission lines being configured to provide a progressive power loss between said resonant loops.

BRIEF DESCRIPTION OF THE DRAWINGS

Embodiments of the invention will now be described more fully with reference to the accompanying drawings, in which.

DETAILED DESCRIPTION OF THE PREFERRED EMBODIMENTS

Figure 1:
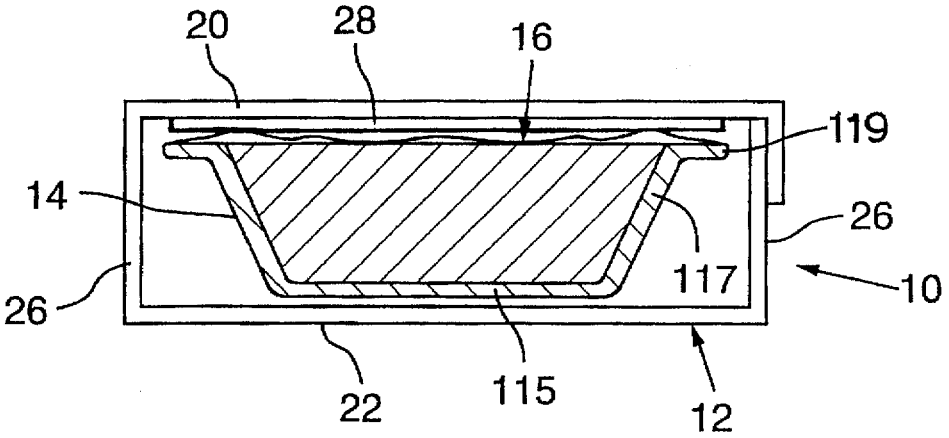
FIG. 1 is a cross-sectional view of a microwavable container in accordance with the present invention.
Figure 4:
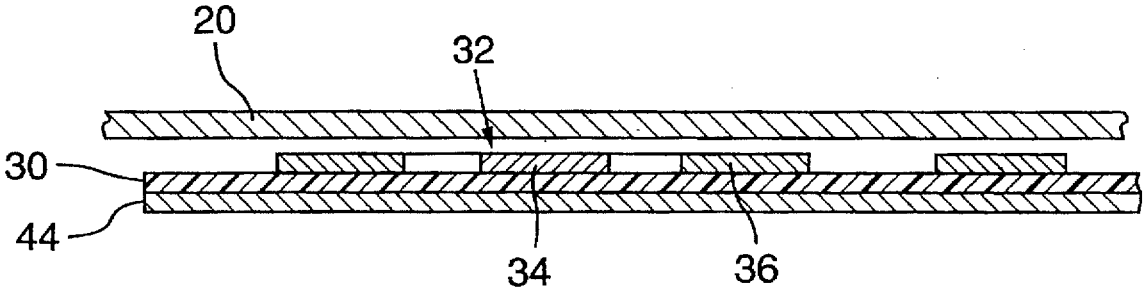
FIG. 4 is a section on the line IV—IV of FIG. 3.

Referring therefore to FIG. 1, a microwavable container 10 includes an outer carton 12 and an inner tray 14 arranged to carry a food product 16. The carton 12 is folded from a paperboard blank 18 shown in FIG. 2 which has top and bottom major panels 20,22 interconnected by side panels 24. Side flaps 26 extend about the edges of major panels 20,22 to the height of the side panel 24 so that upon folding of blank 18 an enclosed rectangular carton with overlapping flaps 26 may be produced as is well known in the art. The exact details of the blank 18 will vary according to the product dimensions and characteristics of the carton required and are provided for illustrative purposes only.

The top major panel 20 is used to support an active microwave energy heating element 28 which is bonded or adhered to the inwardly directed face of the panel 20. The active microwave energy heating element 28 includes a substrate 30 formed of suitable material such as for example, a polymeric film, paper or paperboard. Loops generally indicated at 32 formed of microwave energy interactive material are distributed over the substrate 30. The loops 32 are deposited on the substrate 30 and each comprises an inner ring 34 and an outer ring 36. In the embodiment shown in FIG. 2, the loops 32 are arranged in two arrays 38,40 of different shapes. The inner array 38 is formed by nested, generally triangular rings 35,37 with apexes oriented to a central location to form circular array 38. The outer array 40 is formed by nested circular rings 34,36 which are arranged on circles of increasing diameter about the array 38.

Islands 42 are located between adjacent loops 32. The islands 42 are circular discs of microwave energy interactive material and are sufficiently spaced from the loops 32 so as to be decoupled from them.

Figure 2:
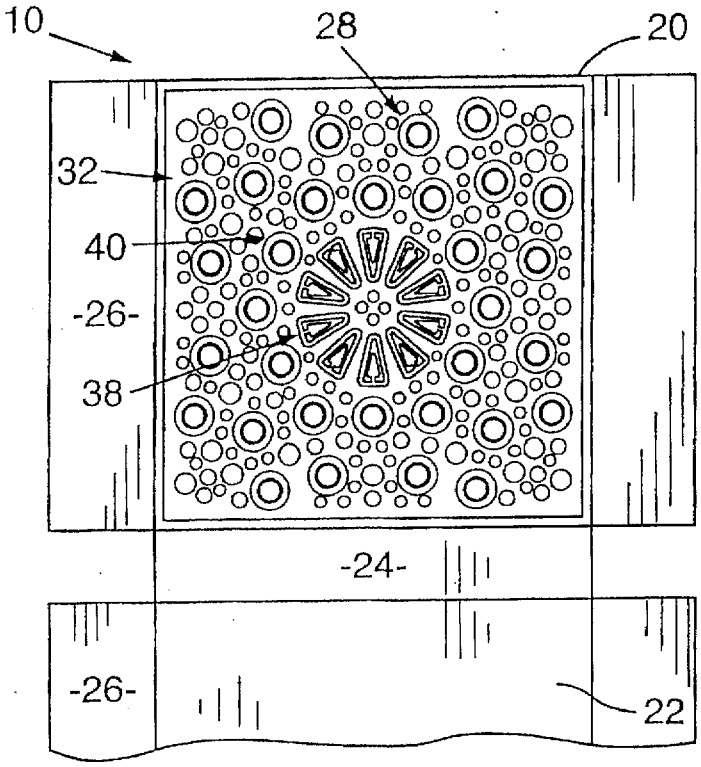
FIG. 2 is a plan view of a blank used to form a carton of the microwavable container of FIG. 1.

In the embodiment of FIGS. 1 and 2, a susceptor 44 including at least one layer of suscepting material is positioned between the active microwave energy heating element 28 and the food product 16 and produces a heating effect upon excitation as is well known. The susceptor 44 may be in the form of a printed ink or alternatively a coating sputtered or evaporated over the active microwave energy heating element 28. Susceptor 44 may not be utilized or additional layers of suscepting material may be provided depending upon the heating effect required. If the susceptor is not used, a plain polymeric film will typically be used in its place.

The microwave energy interactive material forming the loops and discs may be electroconductive or semiconductive material such as metal foil, vacuum deposited metal or metallic ink. The electroconductive material is preferably aluminum although other metals such as copper may be employed. In addition, the electroconductive material may be replaced with a suitable electroconductive, semiconductive or non-conductive artificial dielectric or ferroelectric. Artificial dielectrics comprise conductive subdivided material in a polymeric or other suitable matrix or binder and may include flakes of electroconductive metal such as aluminum. Alternatively, the microwave energy interactive material forming the loops and discs may be in the form of a patterned susceptor including one or more layers of suscepting material.

The islands 42 and loops 32 co-operate to control the transmission and impingement of microwave energy upon the upper surface of the food product 16. As a principle form of control, the loops 38 and islands 42 are reactive with the incident microwave energy so that their nature and extent of their coverage of the major panel 20 determines the amount and distribution of energy transmitted to the upper surface of the food product 16.

Further control can be obtained by the sizing of the loops 32. The loops 32 provide a tuned loop whose field strength is a function of the path length, i.e. the circumference of the loop 32. If the field strength is sufficient, it may lead to charring of the substrate and/or burning of the food product. Accordingly, the diameters of loops 32 may be selected to avoid such charring. At the same time, the field strengths generated by the loops 32 determine the excitation of the susceptor 44 and accordingly the distribution of the loops 32 over the active microwave energy heating element 28 may also control the heating effect of the susceptor and distribute the incident energy in the desired manner.

In general, a uniform effect at each loop 32 is desirable and therefore the loops in array 40 should be radially spaced by a distance selected to optimize heating and browning, if desired, of the food product. In a preferred form, the radial spacing is selected to be equal to $\lambda/4$ where $\lambda$ is the effective wavelength of the microwave energy projected onto the surface of the active microwave energy heating element 28. As those of skill in the art will appreciate, the effective wavelength may vary with different microwave ovens.

The islands 42 principally prevent transmission of energy but they also provide a local excitation at their outer edges. The islands 42 therefore also supplement the effect of loops 32 on the susceptor 44 to increase its effect. Accordingly, the combination of islands and loops may be used to control the transmission and distribution of energy to the food product.

The effect of the distribution of loops in the active microwave energy heating element 28 may also be adjusted by different shapes of loops. As noted above, the array 38 is formed from triangular loops 32. Accordingly, in the arrangement shown in FIG. 2, a localized high intensity field may be generated at the center of the active microwave energy heating element 28 but the size of the loops 32 may be used to control the field strength below that which will prevent charring.

Figure 5:
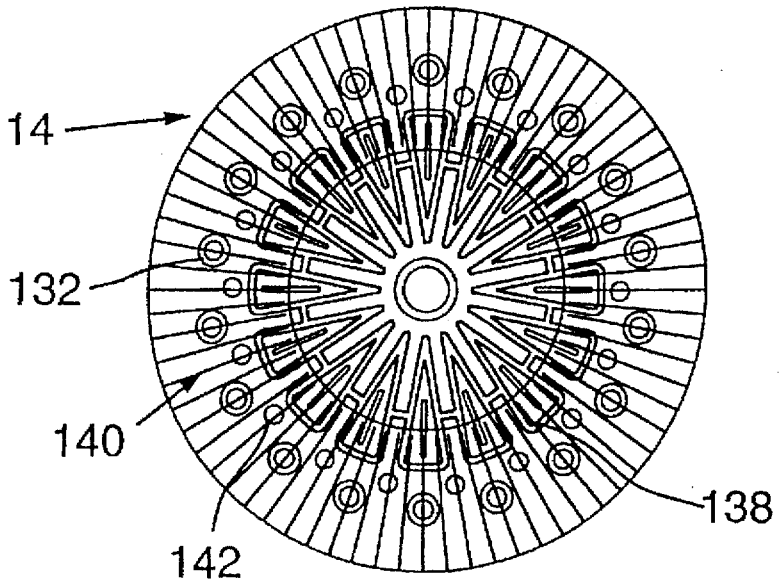
FIG. 5 is a plan view of a tray of the microwavable container of FIG. 1.
Figure 6:
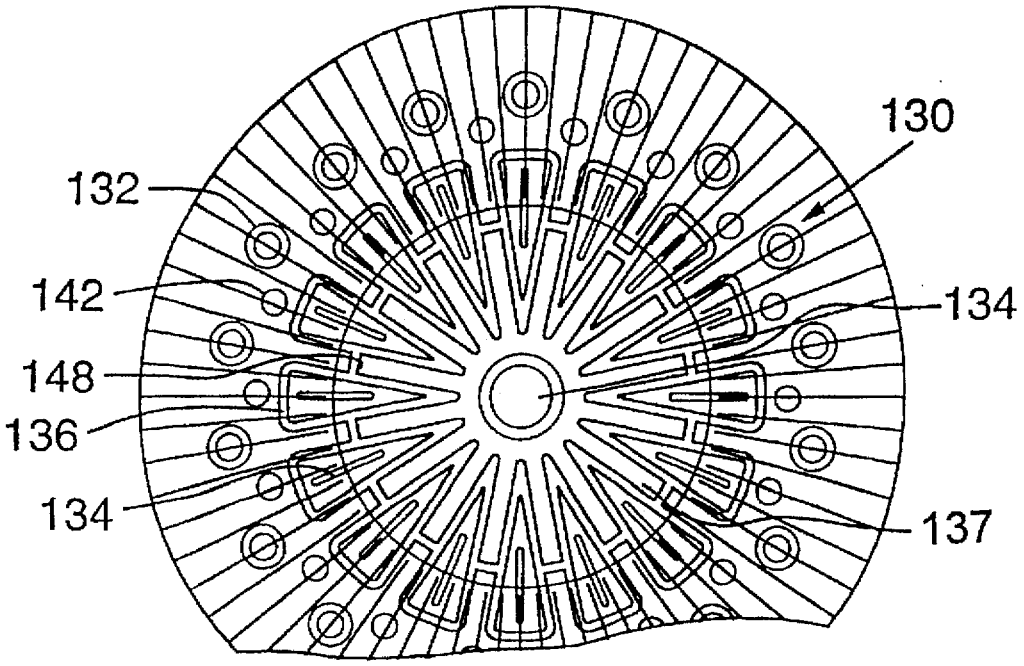
FIG. 6 is an enlarged view of a portion of FIG. 5.

As best shown in FIGS. 1, 5 and 6, similar techniques are utilized with the tray 14 to control the distribution of energy within the food product 16 that is accommodated by the tray 14. The tray in this particular example has a circular base 115 and an upstanding sidewall 117 about the periphery of the base. An out-turned lip 119 is formed about the periphery of the sidewall. The tray 14 is preferably formed of paper or paperboard. Although the tray is shown to be circular in nature, those of skill in the art will appreciate that other geometric shapes may be selected.

Referring therefore to FIGS. 5 and 6, it will be noted that an active microwave energy heating element 130 is provided on the tray 14. The active microwave energy heating element 130 includes loops 132 formed of microwave energy interactive material such as those previously described. The loops 132 are disposed over the base 115 and sidewalls 117 of the tray 14 in a pair of arrays 138,140 and in use would be covered by the food product 16. A susceptor including at least one layer of suscepting material may also be included on the tray overlying the active microwave energy heating element 130 to produce a localized heating effect. The array 140 is formed from circular loops 132 with islands 142 interspersed between the adjacent loops. The array 140 will therefore control the transmission of energy into the sidewalls of the food product 16 and produce local fringing effects.

The array 138 is formed from nested triangular loops 132 each having rings. Bridging elements 148 extend between the outer rings 136 of adjacent loops 132. The bridging elements 148 reduce the field intensity in a region adjacent the junction of the sidewall and base of the tray 14 which it is found tends to be overly excited. The effect of the bridging elements 148 is therefore to redistribute the energy into the apexes of the loops 132 towards the center of the food product to promote absorption of energy at the center rather than at the heel.

In the arrangement shown in FIG. 5, a central loop having an inner circular element 134 and an outer star-like element 137 is provided which provides further distribution of the field intensities over the base of the food product 16.

The distribution of loops 132 within either of the arrays 138,140 may be adjusted to control the transmission of microwave energy into the sidewalls and the distribution of energy within the base of the food product 16.

The active microwave energy heating element 28 may also be used to control the transmission of energy to the tray 14 by selectively omitting the microwave energy interactive material in preselected areas of the active microwave energy heating element 28. An embodiment of such an arrangement is shown in FIG. 7, where like elements will be denoted with like reference numerals with the suffix 'a' added for clarity.

Figure 7:
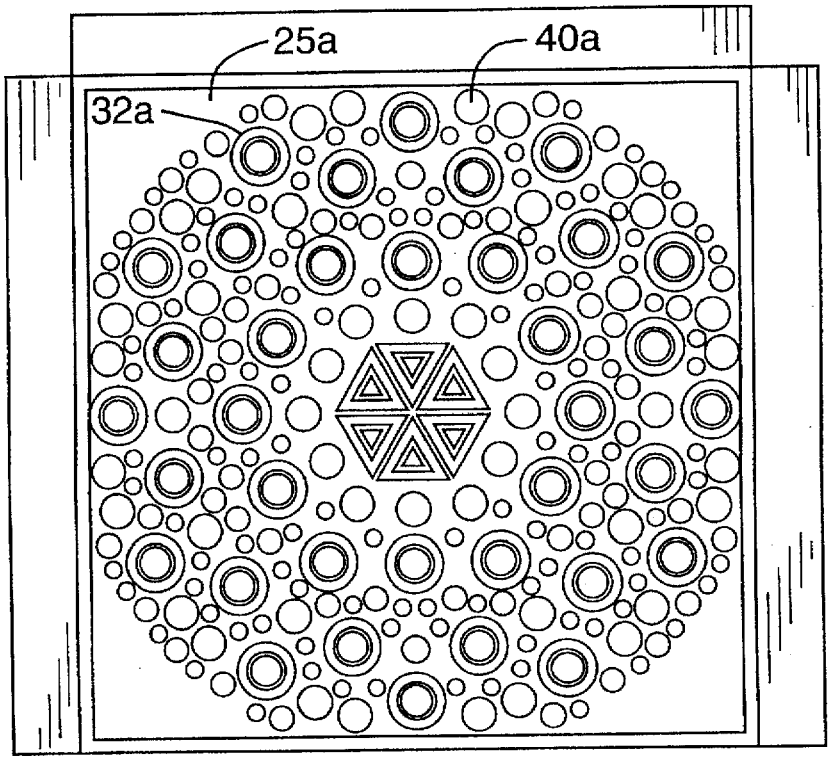
FIG. 7 is a view similar to FIG. 2 of an alternative embodiment of a blank used to form a carton of a microwavable container.

In the embodiment of FIG. 7, it will be noted that the loops 32*a* and islands 40*a* are omitted in the corners of the active microwave energy heating element 28*a*. Thus, the energy incident upon the corners is transmitted into the carton 12 where it is available for transmission through the sidewall 117 of the tray 14*a*. At the same time, however, the food product 16*a* remains within the distribution of loops 32*a* and islands 40*a* so that the distribution of energy over the upper surface of the food product 16*a* is in the desired pattern. By selectively omitting areas of loops and islands, the overall efficiency of the carton 12 may be improved.

In a similar manner, if it is necessary to preclude the transmission of energy in particular areas, a continuous reflective sheet may be provided on the carton 12 in those areas.

Figure 8:
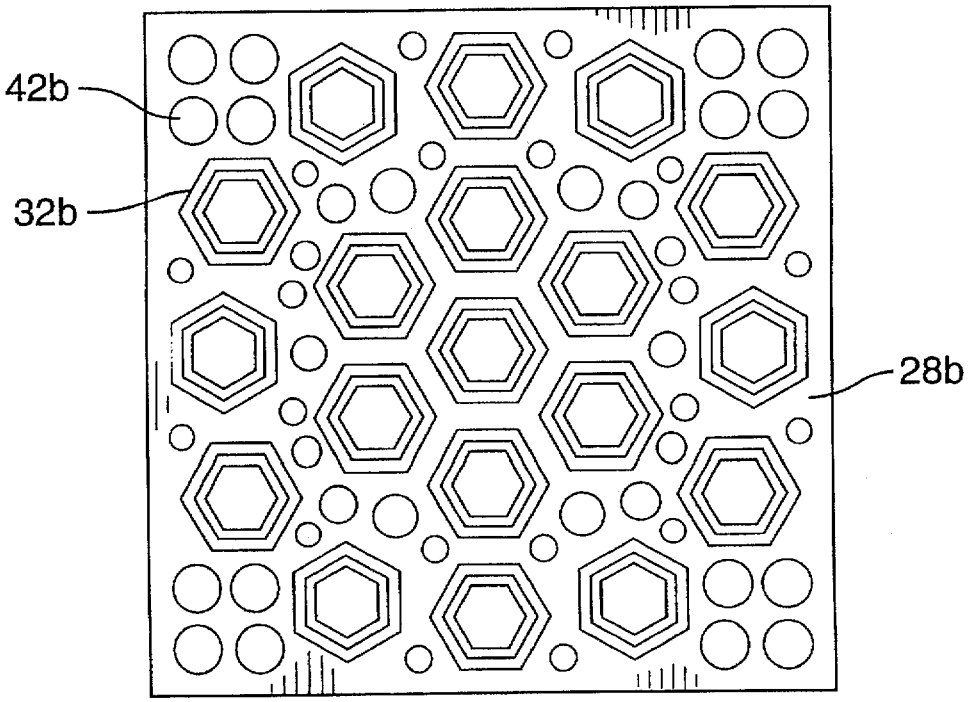
FIG. 8 is a view similar to FIG. 2 of a yet further embodiment of a blank used to form a carton of a microwavable container.

In the above embodiments, loops having circular or triangular configurations are utilized but it will be apparent that alternative shapes may be used. For example, as shown in FIG. 8 where like components will be identified with like reference numerals with the suffix 'b' added for clarity, the loops 32*b* are formed from hexagonal rings that offer a greater path length and therefore a greater energy for a given area. The loops 32*b* are interspersed with islands 42*b* with larger islands arranged as a square configuration in each corner where a hexagon could not be accommodated. Again, it will be noted that the hexagons are arranged in circular arrays about a central hexagon with the radial spacing between the hexagons being selected to optimize heating of the food product. The islands 42*b* are interspersed in the voids between hexagons with sufficient spacing to tailor the coupling between the rings and islands but at the same time providing the required effectiveness of the active microwave energy heating element 28. In this manner, the distribution of energy may be tailored to the particular food product and microwavable container 10.

Figure 3:
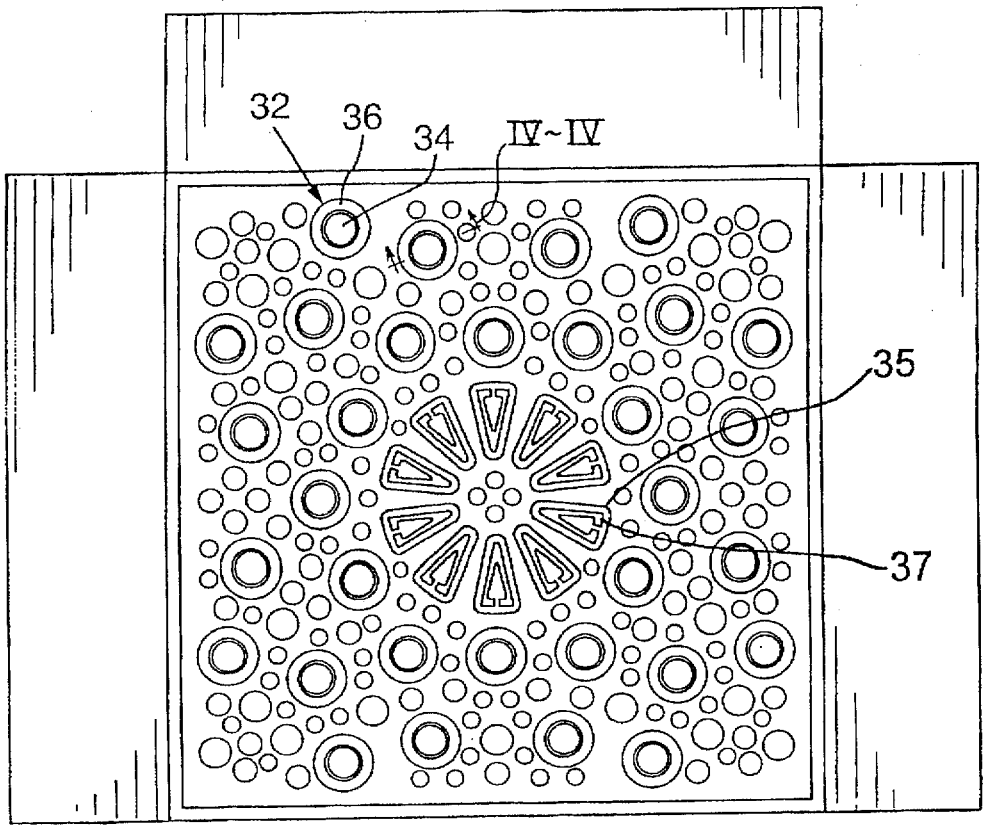
FIG. 3 is an enlarged view of a portion of FIG. 2.

As has been discussed above, the degree of effectiveness of the active microwave energy heating element 28 may be adjusted by selecting the size and distribution of the loops 32 and islands 40. In the embodiment shown in FIGS. 2 and 3, the microwave energy interactive material extends over approximately 57% of the active microwave energy heating element 28. The islands 42 are of three different diameters, namely 3.5 mm., 5.0 mm. and 7 mm., and the circular loops 32 have an outer and inner diameter of loop 34 of 12 mm. and 8 mm. respectively and a diameter of inner loop 36 of 6.5 mm. The array 138 of triangular loops is made up of 10 loops each having an outer peripheral length of 35 mm.

In the arrangement shown in FIG. 7, the microwave energy interactive material covers approximately 59% of the active microwave energy heating element with the islands made up on three different diameters, namely 5 mm., 7 mm. and 10 mm. The ring of the array 140 has a maximum diameter of 7.2 mm., an intermediate diameter of 11.2 mm. and an inner diameter of 9.2 mm. The triangular elements of the array 138 have a side length of 21.2 mm. and a width of 3.0 mm. The path length of the inner triangular element is 5.7 mm.

Obviously, variants of these dimensions may be utilized and these are given by way of example of the nature of the arrays that can be used in an effective manner.

Figure 10:
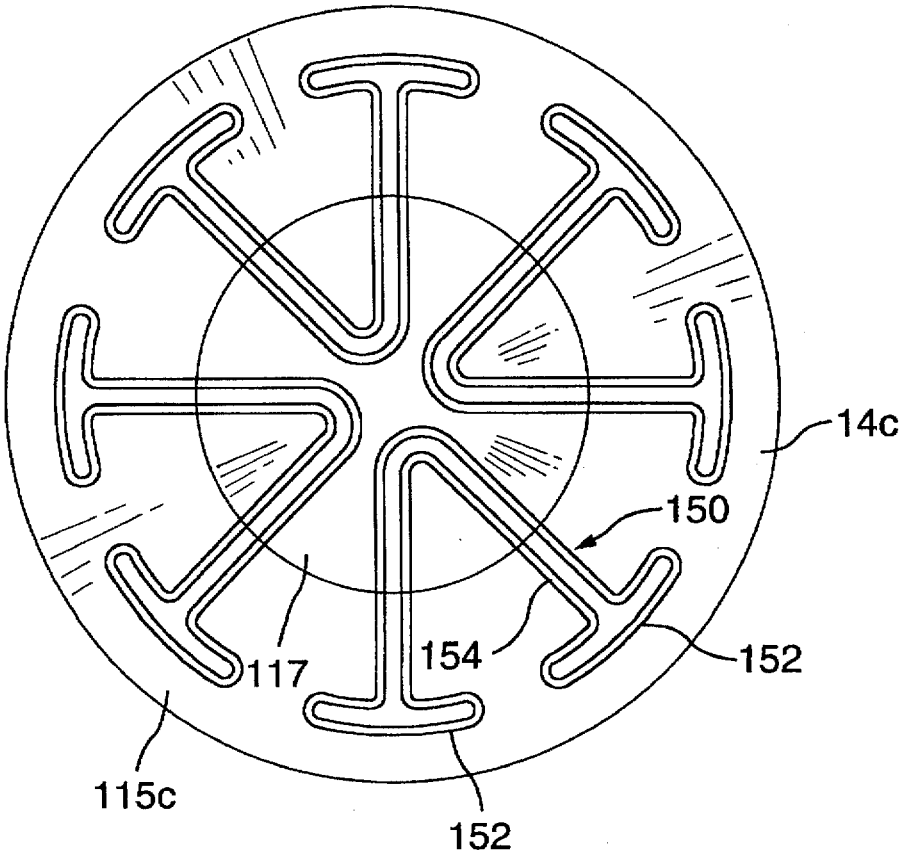
FIG. 10 is a plan view of an alternative embodiment of a tray of the microwavable container of FIG. 1.
Figure 11:
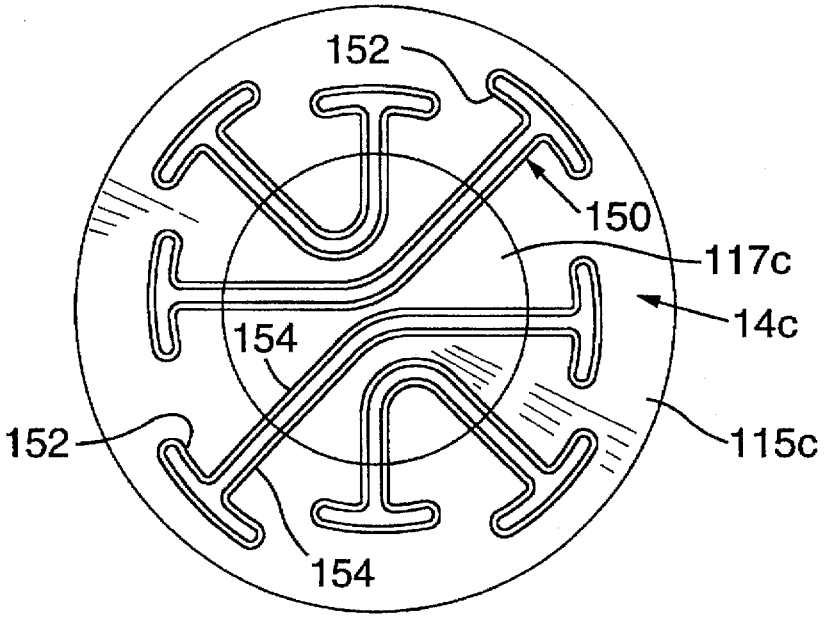
FIG. 11 is a plan view of a still further embodiment of a tray of the microwavable container of FIG. 1.

In the above examples, the distribution of energy within the tray 14 is controlled locally by the provision of loops 132 and islands 140. It has been found with certain food products that a transfer of energy within the tray 14 can be beneficial to produce a uniform heating of the food product 16. Examples of such arrangements for use with trays are shown in FIGS. 9, 10 and 11 where like components will be identified with like reference numerals and a suffix 'c' added for clarity.

Figure 9:
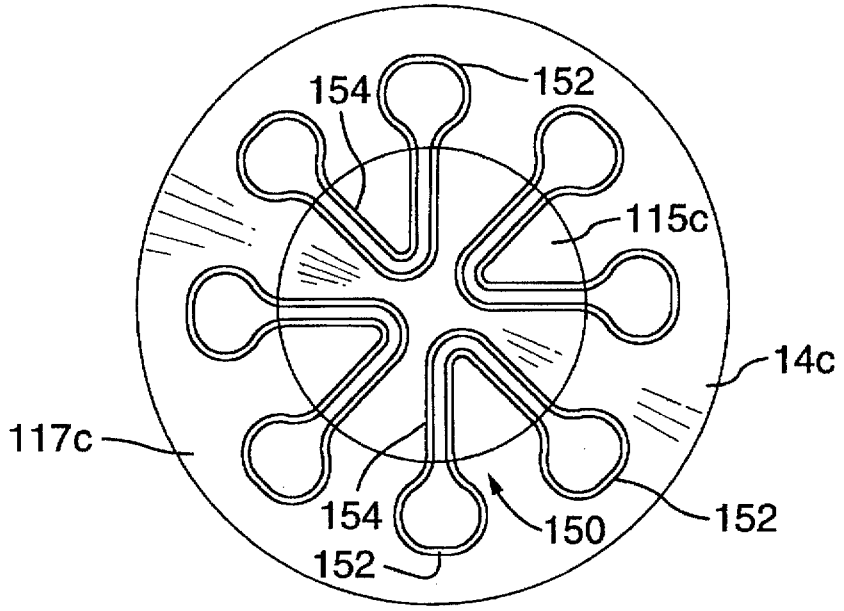
FIG. 9 is a plan view of a further embodiment of a tray of the microwavable container of FIG. 1.

Referring therefore to FIG. 9, tray 14*c* has a plurality of transmission elements 150 in place of the arrays 138,140. Each transmission element includes a pair of loops 152 interconnected by a pair of transmission lines 154. The loops 152 are located on the sidewall 117*c* of tray 14*c* and the transmission lines 154 extend across the base 115*c*.

The loops 152 are tuned to collect energy from the region of the sidewall 117*c* and have a circumference that is close to an integral multiple of the effective wavelength of the incident microwave energy in the food product contained in tray 14*c*. The transmission lines 154 are selected to provide a progressive power loss from each of the tuned loops 152 and are of such length that the power decays toward zero at the mid-point between the loops 152. This is achieved by matching the energy fed by the loops 152 to the transmission line characteristics. Optimally, the lengths of the transmission lines 154 are selected to suit the desired heating requirements. For short lengths, the perimeters of the transmission elements 150 are selected to be approximately equal to integer multiples of the effective wavelength. However, the lengths can be adjusted to detune the transmission elements 150 as required to achieve the desired heating.

In one embodiment, the width of each transmission line 154 was 2 mm. and the spacing between the transmission lines was 5.7 mm. This was found to provide a suitable power loss when in contact with pastry. By adjusting the loop position on the sidewall 117*c*, the circumference of the loops 152 and length of transmission lines 154, a suitable power distribution is achieved.

In the embodiment of FIG. 9, the loops 152 are generally circular. As shown in FIG. 10, the aspect ratio of the loops 152 may be adjusted to suit the dimensions of the tray 14*c* and the length of the transmission lines 154. In FIG. 10, the loops 152 are elongated in the direction of the circumference of the tray 14*c* and are positioned adjacent the upper edge of the sidewall 117*c*. Alternatively, as shown in FIG. 11, where the extremities of the loops 152 are too close to permit the required coupling of the loops, the loops 152 may be staggered relative to one another in the height of the sidewall 117*c*. The length of the transmission lines 154 are maintained equal by having each line extend between an upper loop and a raised loop.

Figure 12:
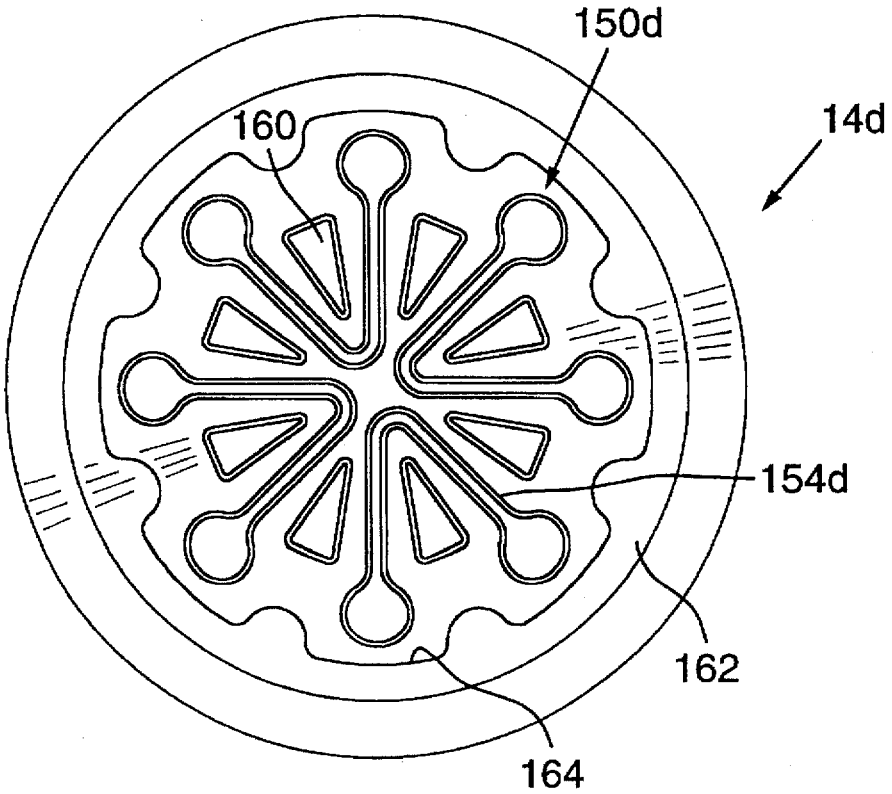
FIG. 12 is a top plan view of still yet another embodiment of a tray of the microwavable container of FIG. 1.

Referring now to FIG. 12, still yet another embodiment of a tray 14*d* similar to that illustrated in FIG. 9 is shown. In this embodiment, like reference numerals will be used to indicate like components of the embodiment of FIG. 9 with the suffix "d" added for clarity. As can be seen, the transmission elements 150*d* are more elongate. A ring of circumferentially spaced triangular loops 160 surrounds the center of the tray 14*d*. The triangular loops alternate between a position located between adjacent transmission elements 150*d* and a position located between transmission lines 154*d* of a transmission element 150*d*. The triangular loops 160 are oriented so that their apexes point to the center of the tray. An outer ring 162 of microwave energy interactive material is provided on the sidewall of the tray 14*d* and has an undulating inner peripheral edge 164.

The effect of the transmission elements 150 therefore is to transfer energy from the sidewalls 117 into the base 115 and dissipate it progressively to provide a uniform heating effect.

It will be noted that in each of the embodiments of FIGS. 9 to 12, the transmission lines 154 are concentrated toward the center of base 115 so that maximum heating effect is achieved in that area. At the same time, however, the field intensities associated with the transmission lines 154 are not sufficient to cause charring of the food product 16 or carton 12 due to the progressive decay of the power.

Thus, in combination with the active microwave energy heating element 28 on the upper panel 20 of carton 12, uniform heating may be achieved without charring of carton and/or food product.

In each of the embodiments shown, the tray 14 is configured to have a sidewall and the energy collecting loops are located on an inwardly directed surface of the tray in close proximity to the food. In this way, the loops may be located to control the distribution of energy within the tray and utilize it to its best effect.

In the embodiments described, the microwavable container 10 includes an active microwave energy heating element 28 on the upper panel 20 of carton 12 and a tray 14 which also includes an active microwave energy heating element 130. Those of skill in the art should appreciate that the active microwave energy heating on the upper panel may be free-floating and inserted into the carton 12 and rest on the tray 14 above the food product. It should also be appreciated that the active microwave energy heating element 28 may be used to overlie a tray 14 which is formed entirely or covered entirely with metal foil or which only includes a susceptor covering the base and sidewalls thereof. Similarly, the tray 14 may be covered with a polymeric film, a metal foil lid or a susceptor.

Although the trays 14*c* have been shown to have a sidewall and a base, it will be appreciated that the trays 14*c* may be planar with the loops disposed over the surface to control distribution of energy within the food product. Such a structure may be useful for example with a tray designed for pizza where energy may be transferred from the periphery to the center of the pizza. A susceptor may be used with such a tray as required and may either be a separate component or may be integrated into the tray itself.

Although particular embodiments of the present invention have been described, those of skill in the art will appreciate that other variations and/or modifications may be made without departing from the scope thereof as defined by the appended claims.

We claim:

1. An active microwave energy heating element for incorporation into a microwavable container having a substrate, said heating element comprising a plurality of energy collecting loops distributed on one surface of said substrate to receive incident microwave energy and each said loops having an inner ring and an outer ring of microwave energy interactive material a plurality of circular islands of microwave energy interactive material spaced from said loops to cooperatively control transmission of microwave energy from said substrate said islands having a perimeter sufficient to limit currents induced therein to below a predetermined level at which charring of said substrate may occur.

2. An active microwave energy heating element according to claim 1 wherein said heating element includes first and second arrays.

3. An active microwave energy heating element according to claim 2 wherein loops of said first array are circular.

4. An active microwave energy heating element according to claim 2 wherein loops of said second array are triangular.

5. An active microwave heating element according to claim 4 wherein conductors of said loops of said second array are interconnected.

6. An active microwave energy heating element according to claim 1 wherein selected areas of said element are devoid of said loops and said islands.

7. An active microwave energy heating element according to claim 1 further including at least one layer of suscepting material associated with one surface thereof.

8. A microwavable container having an outer sleeve, a tray within said sleeve and an active microwave energy heating element within said sleeve and disposed opposite to said tray, said active microwave energy heating element having a substrate, said heating element comprising a plurality of energy collecting loops distributed on one surface of said substrate to receive incident microwave energy and each said loops having an inner ring and an outer ring of microwave interactive material a plurality of circular islands of microwave interactive material located between selected ones of said loops and spaced therefrom to cooperate with said loops to control transmission of microwave energy from said substrate, said islands having an area sufficient to limit fringe currents therein to below a predetermined level at which charring of said substrate may occur.

9. A microwavable container according to claim 8 wherein a support surface of said tray directed toward food to be located on said tray has a plurality of energy distributing structures formed thereon to distribute energy within said tray.

10. A microwavable container according to claim 8 wherein at least one layer of suscepting material is interposed between said active microwave energy heating element and said tray.

11. A microwavable container according to claim 8 wherein selected areas of said active microwave energy heating element are devoid of said loops and said islands to permit unencumbered transmission of energy therethrough.

12. A microwavable container according to claim 11 wherein said selected areas are located adjacent corners of said container.

13. A microwavable container according to claim 9 wherein said energy distributing structures include a plurality of energy collecting loops distributed about said inwardly directed surface.

14. A microwavable container according to claim 13 wherein selected ones of said loops extend across an intersection of a sidewall and base of said tray.

15. A microwavable container according to claim 14 wherein said selected ones of said loops are triangular and have inner and outer rings.

16. A microwavable container according to claim 15 wherein said inner and outer rings are interconnected.

17. A microwavable container according to claim 16 wherein outer rings of adjacent ones of said loops are interconnected.

18. A microwavable container according to claim 13 wherein said selected ones of said loops are interspersed with islands of microwave energy interactive material.

19. A microwavable container according to claim 13 wherein said selected ones of said loops are circular and each said selected ones of said loops has an inner ring and an outer ring.

20. A microwavable container according to claim 8 wherein said energy distributing structures include a plurality of transmission elements each having a pair of resonant loops interconnected by spaced parallel transmission lines.

21. A microwavable container according to claim 20 wherein said resonant loops are located on a sidewall of said tray at circumferentially spaced locations and said transmission lines extend across a base of said tray.

22. A microwavable container according to claim 21 wherein said transmission lines have transmission characteristics to provide a progressive power loss between said resonant loops.

23. A microwavable container according to claim 22 wherein power decays toward zero at a midpoint of said transmission lines between said resonant loops.

24. A microwavable container according to claim 21 wherein said resonant loops are circular.

25. A microwavable container according to claim 21 wherein said resonant loops are elongate.

26. A microwavable container according to claim 25 wherein said loops are arranged about a periphery of a sidewall of said tray.

27. A microwavable container according to claim 26 wherein each loop of an energy distributing structure is located at different heights on said sidewall.

28. A tray for a microwavable container, said tray having a substrate, a food contacting surface to support and contain a food product and a plurality of energy distributing structures formed adjacent said food contacting surface to distribute energy within said tray, said energy distributing structures including a plurality of energy collecting loops distributed about said food contacting surface, pairs of said loops being interconnected by transmission lines having transmission characteristics to provide a progressive power loss between said pairs of loops.

29. A tray according to claim 28 wherein said loops are interspersed with circular islands of microwave interactive material.

30. A tray according to claim 28 wherein each said loops has an inner ring and an outer ring.

31. A tray according to claim 30 wherein said inner and outer rings are interconnected.

32. A tray according to claim 31 wherein said rings are circular.

33. A tray according to claim 28 wherein said loops are circular.

34. A tray according to claim 28 wherein said loops and transmission lines each have a path length that is substantially an integral multiple of the effective wavelength of the incident microwave energy.

35. A tray for a microwavable container comprising a substrate and a plurality of energy collecting structures disposed across a surface of said substrate, said structures including resonant loops having a perimeter sufficient to limit currants induced therein to below a predetermined level whereby upon impingement by incident microwave energy said structures distribute energy across said surface and thereby inhibit charring of said substrate, pairs of said resonant loops being interconnected by transmission lines, said transmission lines having transmission characteristics to provide a progressive power loss between said resonant loops.

36. A tray according to claim 35 wherein the perimeter of said resonant loops and the length of each of said transmission lines is an integer multiple of the effective wavelength of incident microwave energy.

* * * * *